US010138714B2

(12) United States Patent
Ward

(10) Patent No.: US 10,138,714 B2
(45) Date of Patent: Nov. 27, 2018

(54) SUBSEA NOISE MITIGATION SYSTEMS AND METHODS

(75) Inventor: John Michael Ward, Katy, TX (US)

(73) Assignee: SHELL OIL COMPANY, Houston, TX (US)

( * ) Notice: Subject to any disclaimer, the term of this patent is extended or adjusted under 35 U.S.C. 154(b) by 1383 days.

(21) Appl. No.: 13/696,835

(22) PCT Filed: May 9, 2011

(86) PCT No.: PCT/US2011/035707
§ 371 (c)(1),
(2), (4) Date: Nov. 8, 2012

(87) PCT Pub. No.: WO2011/143092
PCT Pub. Date: Nov. 17, 2011

(65) Prior Publication Data

US 2013/0056270 A1 Mar. 7, 2013

Related U.S. Application Data

(60) Provisional application No. 61/333,392, filed on May 11, 2010.

(51) Int. Cl.
*E21B 41/00* (2006.01)

(52) U.S. Cl.
CPC ..... *E21B 41/0007* (2013.01)

(58) Field of Classification Search
CPC ..... E21B 7/12; E21B 41/0007
USPC ..... 166/358, 243; 175/5; 181/175
See application file for complete search history.

(56) References Cited

U.S. PATENT DOCUMENTS

| | | | | |
|---|---|---|---|---|
| 2,097,862 | A * | 11/1937 | McKay | B29D 23/001 138/126 |
| RE28,095 | E * | 7/1974 | Chapin | A01G 25/02 138/114 |
| 4,873,810 | A | 10/1989 | Lecaroz | 52/575 |
| 6,567,341 | B2 | 5/2003 | Dreyer et al. | 361/1 |
| 8,636,101 | B2 * | 1/2014 | Elmer | 181/175 |
| 2005/0152749 | A1 | 7/2005 | Anres et al. | 405/224 |
| 2009/0012987 | A1 | 1/2009 | Kaminsky et al. | 707/102 |
| 2009/0121336 | A1 | 5/2009 | Kim | |
| 2009/0129871 | A1 | 5/2009 | Mohr | |
| 2011/0031062 | A1 † | 2/2011 | Elmer | |

FOREIGN PATENT DOCUMENTS

| | | | |
|---|---|---|---|
| CA | 2719344 | 10/2009 | B02B 17/00 |
| DE | 10302219 | 9/2004 | |
| DE | 102008017418 | 10/2009 | |

(Continued)

OTHER PUBLICATIONS

McCauley, Radiated Underwater Noise Measured From the Drilling Rig Ocean General . . . , 54 pages, Jul. 1998, Centre for Marine Science and Technology Curtin University of Technology Western Australia 6102.†

*Primary Examiner* — Matthew R Buck
*Assistant Examiner* — Aaron L Lembo

(57) ABSTRACT

A system and method of exploiting an offshore oil and gas reservoir, comprising installing a drilling structure in a body of water; drilling a plurality of wells from the drilling structure; and providing a plurality of buoyant, flexible structures adjacent to the well.

3 Claims, 6 Drawing Sheets

(56) References Cited

FOREIGN PATENT DOCUMENTS

| | | | |
|---|---|---|---|
| WO | 2003062534 | 7/2003 | |
| WO | WO20080006478 | 1/2008 | ..... C07D 213/82 |
| WO | WO2008074886 | 6/2008 | ..... B63B 27/00 |

* cited by examiner
† cited by third party

SUBSEA NOISE MITIGATION SYSTEMS AND METHODS

PRIORITY CLAIM

The present application claims priority from PCT/US2011/035707, filed 9 May 2011, which claims priority from U.S. provisional application 61/333,392, filed 11 May 2010.

FIELD OF THE INVENTION

The present invention is directed to mitigating the underwater noise caused by subsea operations, for example noise caused by a subsea oil and gas operation.

BACKGROUND ART

PCT Patent Publication Number WO 2008/074886 discloses a swell limiting device onboard a floating structure for facilitating the transloading between the structure and a transfer ship, characterised in that it comprises on at least one of its sides (port, starboard) a pneumatic breakwater comprising a perforated duct supplied with a gas from a pressurised gas source, said duct being adapted to be submerged and for producing, when submerged, a gas bubble curtain creating a stream against the swell for limiting the amplitude thereof on the protected side, thus permitting the secured docking and transloading of passengers, equipment and goods between said floating structure and the transfer ship. PCT Patent Publication Number WO 2008/074886 is herein incorporated by reference in its entirety.

U.S. Patent Application Publication Number 2008/0006478 discloses a sound attenuation sleeve for use on a piling during underwater construction and a method of using such a sleeve for attenuating underwater transmission of sound and/or shock waves during underwater pile driving operations. U.S. Patent Application Publication Number 2008/0006478 is herein incorporated by reference in its entirety.

U.S. Pat. No. 6,567,341 discloses methods of attenuating underwater transmission of sound or shock waves as well as boom systems designed for such use. The boom system is characterized by a material (e.g., curtain or combination curtain and skirt) which extends substantially the entire water column when placed in a body of water, thereby defining a perimeter and a gas injection system which includes a plurality of outlets which are positioned between the perimeter and the site of underwater activity. In use, the boom system is installed such that it surrounds the site of underwater activity and then gas is injected into the water through the plurality of outlets to form a gas curtain during performance of an underwater activity capable of generating sound or shock waves. U.S. Pat. No. 6,567,341 is herein incorporated by reference in its entirety.

There is a need in the art for one or more of the following:

An improved system and method of decreasing noise pollution in a subsea environment;

An improved system and method of operating in a subsea environment while reducing the impact on marine life.

SUMMARY OF INVENTION

In one aspect of the invention, there is disclosed a method of exploiting an offshore oil and gas reservoir, comprising installing a drilling structure in a body of water; drilling a plurality of wells from the drilling structure; and providing a plurality of buoyant, flexible structures adjacent to the well.

In another aspect of the invention, there is disclosed an offshore system in a body of water, comprising a drilling structure at a surface of the body of water; a drill bit in a well beneath a bottom of the body of water; an environmentally sensitive area offset a distance from the well; and a plurality of buoyant, flexible structures arrayed between the well and the environmentally sensitive area.

Advantages of the invention may include one or more of the following:

An improved system and method of decreasing noise pollution in a subsea environment;

An improved system and method of operating in a subsea environment while reducing the impact on marine life.

DETAILED DESCRIPTION

Figure 1:
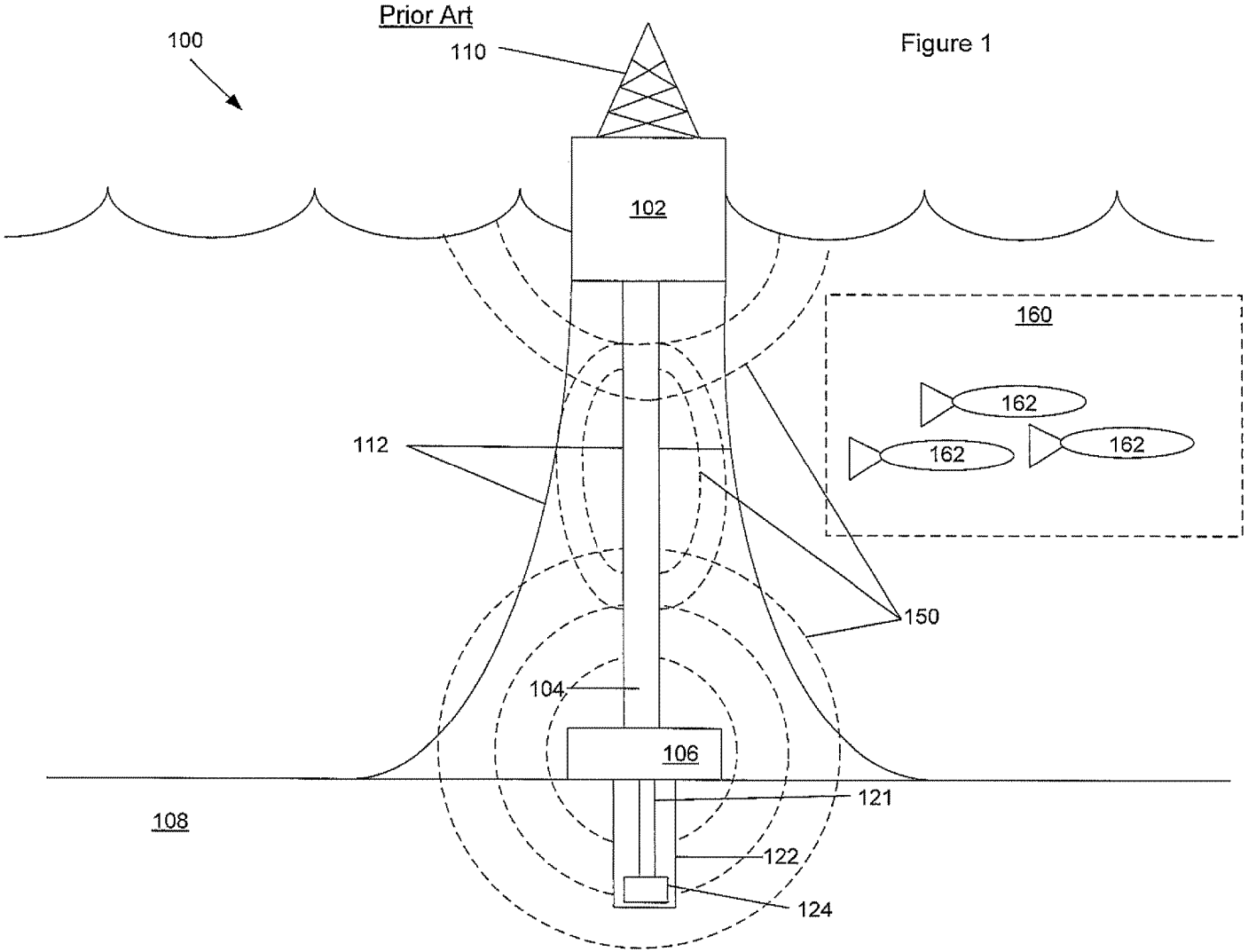
FIG. 1 shows a prior art drilling structure.

FIG. 1:

Referring to FIG. 1, prior art system 100 is shown. System 100 includes a floating structure 102 connected to the sea floor by multiple mooring or anchor lines 112. Floating structure 102 includes drilling rig 110 to drill wells 122 in the sea floor 108 with a drill bit 124 on drill string 121. Floating structure 102 is connected to a wellhead 106 by riser 104. Drill string 121 may be located within riser 104.

In general, floating structure 102 may be temporarily or permanently moored on location. System 100 produces significant noise from the drilling operations. The noise is represented in the drawings as sound waves 150 originating from the floating structure 102 and riser 104. The propagation of sound waves 150 is generally undesirable as they may travel to environmentally sensitive areas 160 and may disturb marine wildlife 162.

Although a floating structure 102 is shown in figure, other structures may be used for subsea oil and gas operations or other types of subsea operations as are known in the art. Additionally, the art described herein may be used to decrease underwater noise from other moored floating structures such as boats, ships, and barges.

Figure 2A:
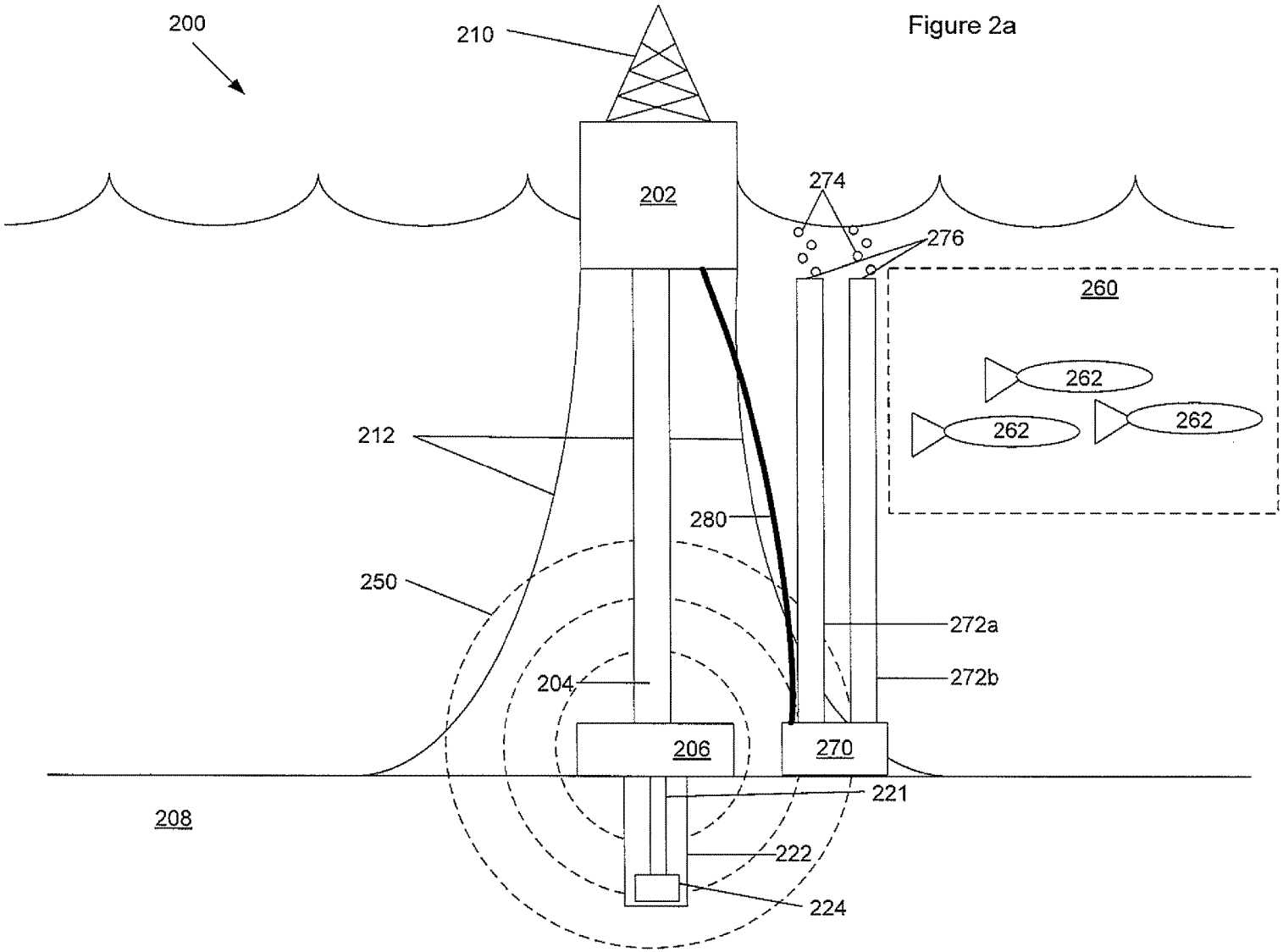
FIGS. 2A, and 2B show a drilling structure with a noise mitigation system.
Figure 2B:
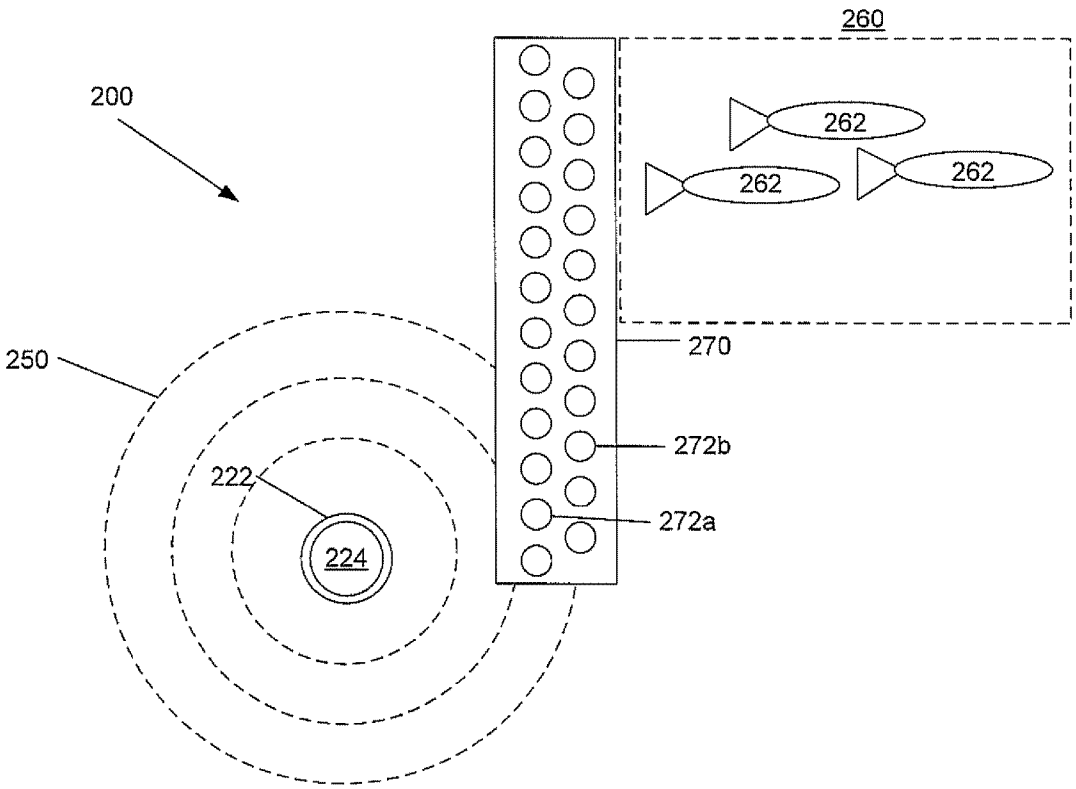

FIGS. 2*a* & 2*b*:

Referring to FIG. 2A, a drilling system 200 is shown in accordance with embodiments of the present disclosure. The drilling system 200 includes drilling structure 202, such as a drill ship, semi-submersible drilling unit or barge, which may be floating or may be standing on the seafloor 208.

Drilling structure 202 may be connected to the sea floor 208 by multiple mooring or anchor lines 212. Floating structure 202 is connected to a subsea structure such as wellhead 206 by riser 204.

Floating structure 202 includes drilling rig 210 to drill wells 222 in the sea floor 208 with a drill bit 224 on drill string 221. Drill string 221 may be located within riser 204.

The subsea drilling operation with drill bit 224 drilling wells 222 creates noise and/or vibrations represented by sound waves 250. The propagation of sound waves 250 is generally undesirable as they may travel to environmentally sensitive areas 260 and may disturb marine wildlife 262.

Anchor block 270 is provided and is connected to a plurality of buoyant flexible tubes 272*a* and 272*b*. As illustrated, tubes 272*a* and 272*b* are hollow and may be injected at the bottom of tubes 272*a* and 272*b* with a volume of gas from supply line 280 to inflate the tubes. Small openings 276 may be provided at the top of tubes which allow gas bubbles up 274 to escape.

In some embodiments, tubes 272*a* and 272*b* may be a solid, flexible buoyant material, such as rubber, plastic, or plant material, which may be connected to anchor block 270.

In some embodiments, there may be no tubes, and gas bubbles may flow from openings in anchor block 270.

In some embodiments, tubes 272*a* and 272*b* may be a hollow, flexible buoyant material, such as rubber or plastic, which may be inflated, and connected to anchor block 270, but which are not provided with openings 276. In the embodiments where tubes 272*a* and 272*b* are filled with a gas, gas supply hose 280 may be connected from floating structure 202 to anchor block 270 which is in turn connected to tubes 272*a* and 272*b*.

In one embodiment tubes 272*a* and 272*b* are flat hoses, similar to fire hoses, that can be shipped and deployed in the un-inflated rolled up condition. Once deployed they can be inflated, unrolling them to their upright position In operation, tubes 272*a* and 272*b* may be used as a buffer for the sound waves 250 between the drilling operations at the wellhead 206 and the environmentally sensitive areas 260.

As shown in FIG. 2B, tubes 272*a* and 272*b* maybe arrayed in a line on anchor block 270 to separate the drilling operations at the wellhead 206 and the environmentally sensitive areas 260. Tubes 272*a* may be offset from tubes 272*b* to allow marine life and water currents to flow through the line, while blocking at least a portion of sound waves 250.

Although two lines of tubes are shown, in some embodiments, there may be provided only 1 line of tubes, while in other embodiments from 2-10 lines, for example from 3-6 lines of tubes may be used.

Figure 3:
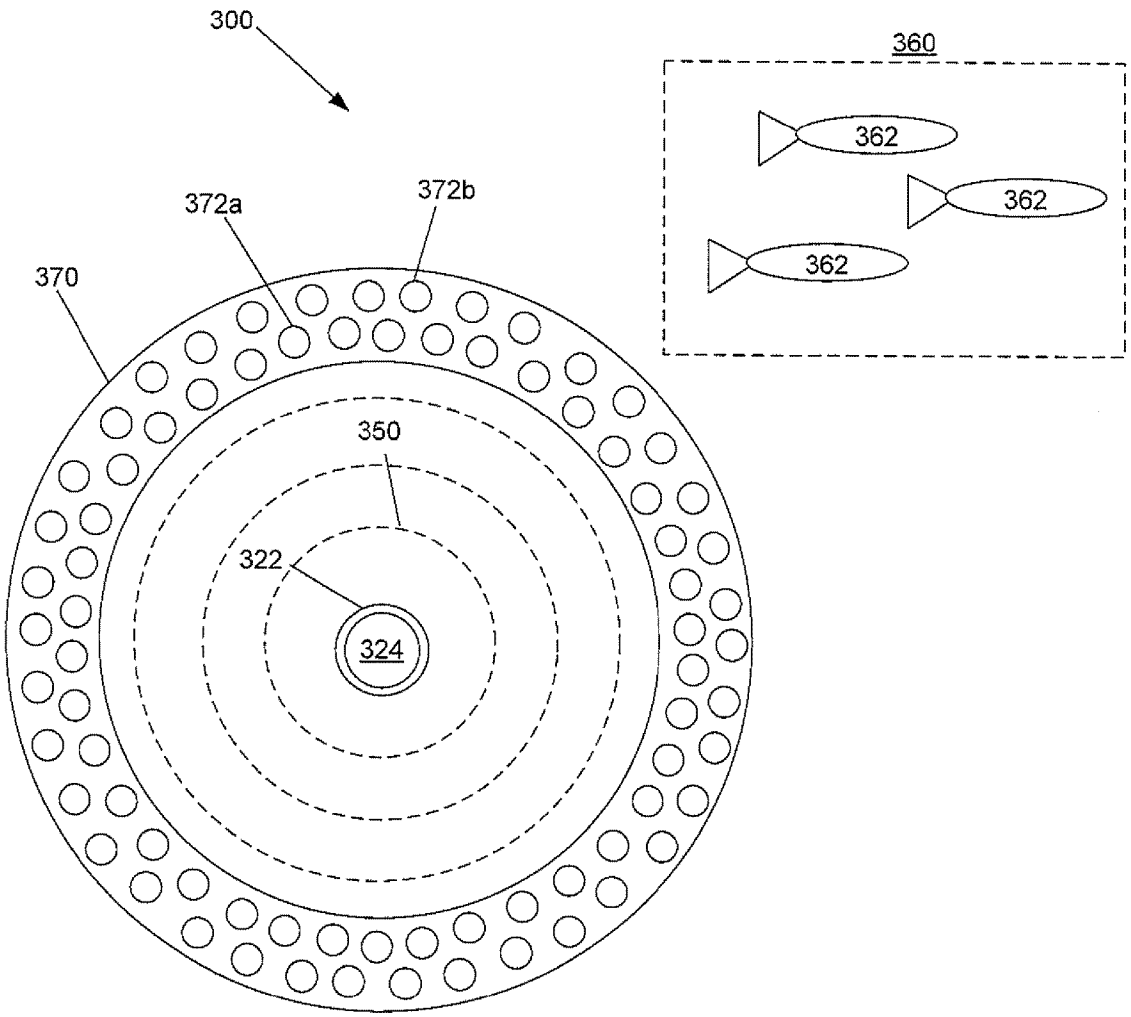
FIG. 3 shows a noise mitigation system.

FIG. 3:

In some embodiments, as shown in FIG. 3, tubes 372*a* and 372*b* maybe arrayed in a circle on anchor block 370 to surround the drilling operations at the wellhead 306 and to keep the sound waves 350 from reaching environmentally sensitive areas 360. Tubes 372*a* may be offset from tubes 372*b* to allow marine life and water currents to flow through the circle, while blocking at least a portion of waves 350.

Figure 4:
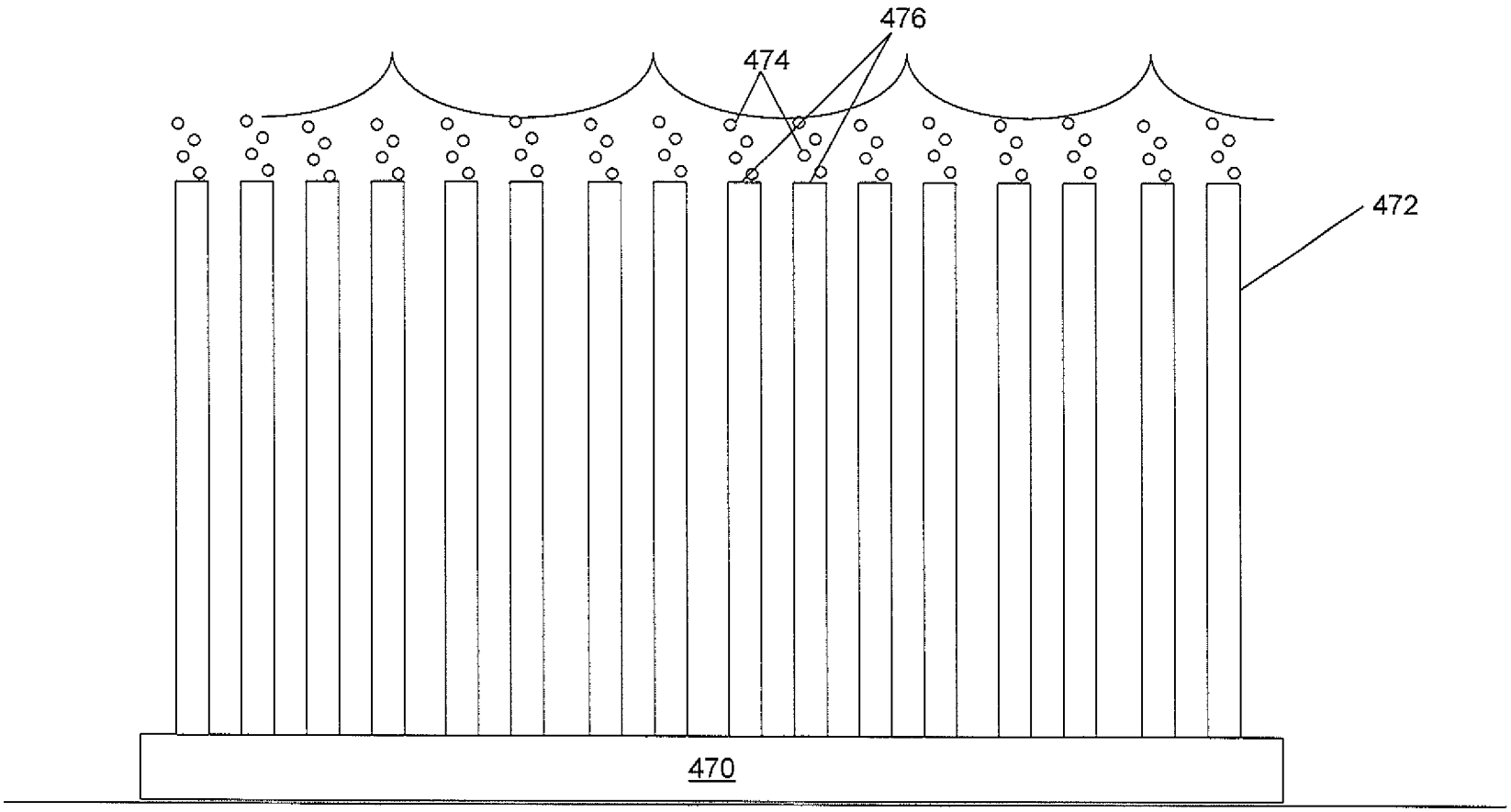
FIG. 4 shows a noise mitigation system.

FIG. 4:

In some embodiments, as shown in FIG. 4, tubes 472 may be attached to anchor block 470 to keep sound waves (not shown) from reaching environmentally sensitive areas (not shown). Tubes 472 may be an inflatable, flexible, material which are filled with a gas from anchor block 470, and are provided with small openings 476 at the top of tubes 472 to allow gas bubbles 474 to escape from the top of tubes 472.

Figure 5:
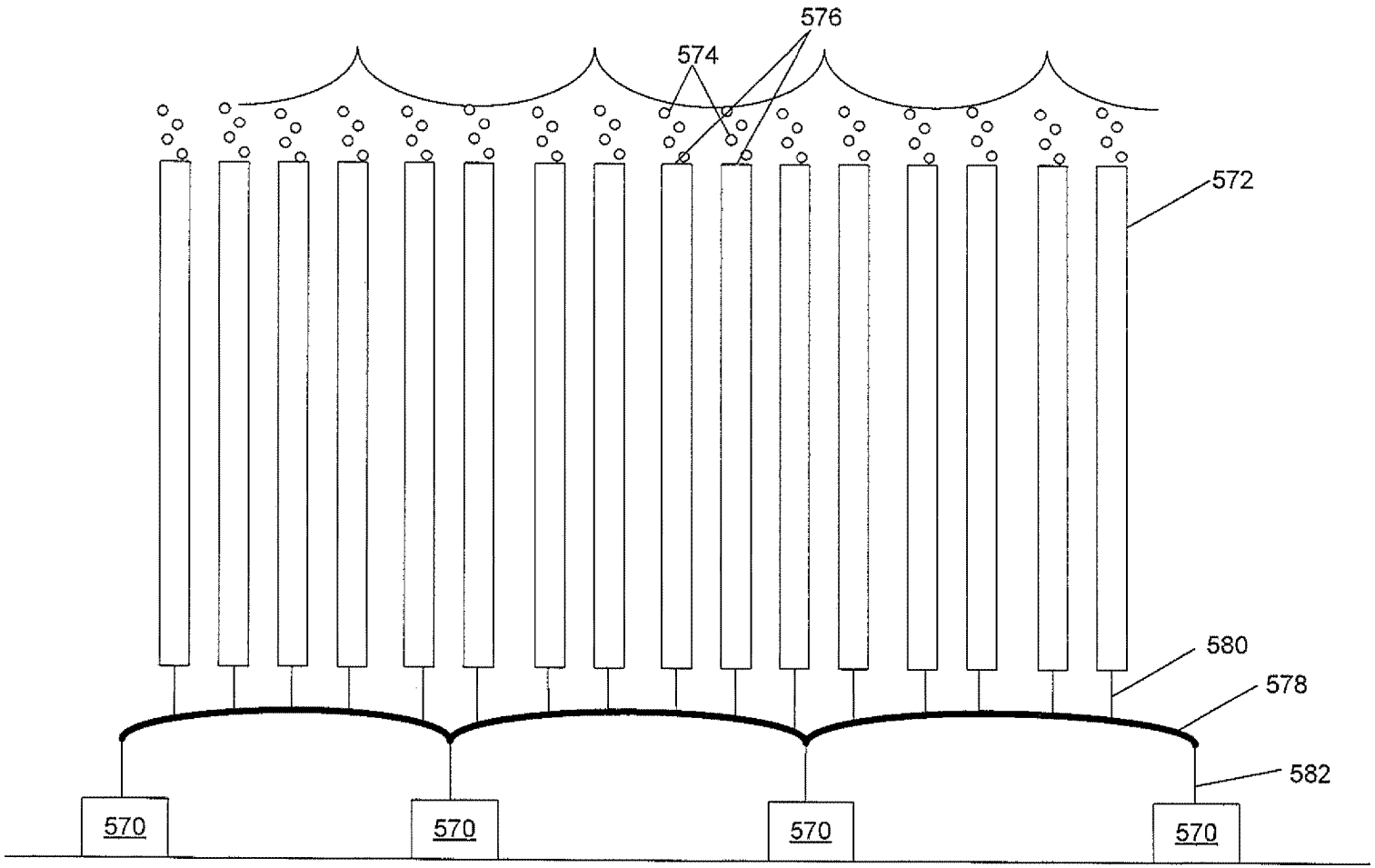
FIG. 5 shows a noise mitigation system.

FIG. 5:

In some embodiments, as shown in FIG. 5, tubes 572 may be attached to a gas line and support cable 578 by connectors 580. At various points throughout its length, support cable 578 is attached to anchor blocks 570 by connectors 582. Tubes 572 act to keep sound waves (not shown) from reaching environmentally sensitive areas (not shown). Tubes 572 may be an inflatable, flexible, material which are filled with a gas from gas line and support cable 578, and may be provided with small openings 576 at the top of tubes 572 to allow gas bubbles 574 to escape from the top of tubes 572.

Illustrative Embodiments

In one embodiment, there is disclosed an offshore system in a body of water, comprising a drilling structure at a surface of the body of water; a drill bit in a well beneath a bottom of the body of water; an environmentally sensitive area offset a distance from the well; and a plurality of buoyant, flexible structures arrayed between the well and the environmentally sensitive area. In some embodiments, the drilling structure is floating in the body of water. In some embodiments, the buoyant, flexible structures are filled with a gas. In some embodiments, the buoyant, flexible structures are filled with air. In some embodiments, the system also comprises at least one anchor block at the bottom of the body of water, wherein at least one of the buoyant, flexible structures are attached to the anchor block. In some embodiments, the drilling structure comprises a source of gas to fill the buoyant, flexible structures. In some embodiments, the buoyant, flexible structures are filled with air, and wherein the buoyant, flexible structures comprising least one opening at a top of the structure to allow a portion of the air to escape. In some embodiments, the buoyant, flexible structures completely surround the well. In some embodiments, the system also comprises at least two lines of buoyant, flexible structures, wherein the lines are offset from one another. In some embodiments, the buoyant, flexible structures are filled with air, wherein the drilling structure comprises a source of air connected to the buoyant, flexible structures.

In one embodiment, there is disclosed a method of exploiting an offshore oil and gas reservoir, comprising installing a drilling structure in a body of water; drilling a plurality of wells from the drilling structure; and providing a plurality of buoyant, flexible structures adjacent to the well. In some embodiments, the method also comprises inflating the buoyant, flexible structures with air. In some embodiments, the method also comprises inflating the buoyant, flexible structures with air by pumping air from the drilling structure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of exploiting an offshore oil and gas reservoir, comprising:

installing a drilling structure in a body of water;

drilling a well from the drilling structure;

deploying a plurality of buoyant, flexible structures adjacent to the well, wherein the buoyant, flexible structures are flat hoses that are deployed in an uninflated rolled up condition adjacent the seafloor; and inflating the plurality of buoyant, flexible structures with a gas into an upright position after being deployed.

2. The method of claim 1, wherein the buoyant, flexible structures are inflated with air.

3. The method of claim 1, wherein the buoyant, flexible structures are inflated with air by pumping air from the drilling structure.

* * * * *